US005753104A

United States Patent [19]

Hoecker et al.

[11] Patent Number: 5,753,104

[45] Date of Patent: May 19, 1998

[54] PHYSICAL SEPARATION PROCESSES FOR MINERAL SLURRIES

[75] Inventors: Walter Hoecker; Andrew Newell, both of Chatswood N.S.W., Australia

[73] Assignee: Boc Gases Australia Limited, Australia

[21] Appl. No.: 666,432

[22] PCT Filed: Jul. 4, 1995

[86] PCT No.: PCT/AU95/00403

§ 371 Date: Jun. 25, 1996

§ 102(e) Date: Jun. 25, 1996

[87] PCT Pub. No.: WO96/01150

PCT Pub. Date: Jan. 18, 1996

[30] Foreign Application Priority Data

Jul. 6, 1994 [AU] Australia ..... PM 6680

[51] Int. Cl.[6] ..... B03D 1/02

[52] U.S. Cl. ..... 209/167

[58] Field of Search ..... 209/166, 167; 252/61

[56] References Cited

U.S. PATENT DOCUMENTS

| | | |
|---|---|---|
| 1,505,323 | 8/1924 | Eberenz . |
| 3,655,044 | 4/1972 | Delaney . |
| 3,883,421 | 5/1975 | Cutting . |
| 4,011,072 | 3/1977 | Holman . |
| 4,288,315 | 9/1981 | Morrisey . |
| 4,457,850 | 7/1984 | Tesmann et al. . |

FOREIGN PATENT DOCUMENTS

| | | |
|---|---|---|
| 24695/71 | 9/1974 | Australia . |
| 1070034 | 1/1980 | Canada . |
| 0597522 | 5/1994 | European Pat. Off. . |

OTHER PUBLICATIONS

Derwent Abstract Accession No. 87–019670/03, JP, A, 86/059183–B (Dowa Mining Co. Ltd.) Dec. 15, 1986.

*Primary Examiner*—Thomas M. Lithgow

*Attorney, Agent, or Firm*—Burns, Doane, Swecker & Mathis, LLP

[57] ABSTRACT

A flotation process for the separation of a mineral of non-sulphidic character, such as a talcose mineral, from a mineral of sulphidic character, for example a base metal sulphide, characterized in that a slurry containing a mixture of the minerals is subjected to a sequence of mineral dressing operations in which a non-oxidizing gas or gas mixture and a reducing agent are added to the slurry to maintain an electrochemical potential conducive to the separation of the minerals by flotation.

18 Claims, No Drawings

PHYSICAL SEPARATION PROCESSES FOR MINERAL SLURRIES

FIELD OF THE INVENTION

This invention relates to the physical separation of minerals and, in particular, to the separation of minerals of different mineralogical character.

BACKGROUND OF THE INVENTION

There exists a number of non-sulphide minerals, including carbonaceous minerals (e.g graphite, carbon based residues as exist in Mt Isa, Australia ore bodies), talcose minerals (e.g talc, brucite etc which are associated with Western Australian nickel deposits and the Woodlawn, New South Wales, Australia base metal deposit) as well as amphiboles that have naturally hydrophobic surfaces.

As a result, these "gangue" minerals float readily and are very difficult to separate from other valuable minerals, notably the sulphide minerals (e.g chalcopyrite ($CuFeS_2$), pentlandite $(Ni,Fe)_9S_8$) and sphalerite (ZnS)). When present in mineral concentrates, these "gangue" minerals often attract penalty charges at the smelter and, indeed, may be the cause of rejection of the concentrate by the smelter.

Two approaches to this problem exist in practice, namely to minimise the flotation of the non-sulphide "gangue" minerals using specific reagents or, alternatively, to encourage flotation of the "gangue" minerals in a pre-flotation step prior to the flotation of the desired minerals.

In the first approach, reagents such as depressants (guar gum, CMC, etc) or dispersants (e.g sodium silicate, etc.) are employed to minimise the flotation rate of the non-sulphidic minerals. While successful to some extent, the use of these reagents is non-specific and adversely affects the flotation behaviour of the sulphide minerals in terms of metallurgy as well as froth structure. In addition, such reagents are costly and, if it were possible, would be avoided.

Furthermore, the use of such reagents not only adversely affects flotation behaviour, it affects downstream operations such as dewatering and settling of the minerals. Additionally, and particularly with depressants, there is a requirement to add more reagent at each stage of the separation process.

In the second approach, a separate flotation system is dedicated to the recovery of the naturally floating mineral. Reagents are added to prevent the flotation of the valuable sulphide minerals, however with varying degrees of success and losses due to flotation and entrainment may occur. Inevitably, there will be at least some loss of the valuable by undesired flotation mineral with the gangue recovered from the pre-flotation system. Such losses represent an economic disincentive and would ideally be avoided.

It is therefore a first object of the present invention to provide a physical separation process for the separation of a non-sulphidic mineral from a sulphidic mineral in which losses of sulphidic mineral by uncontrolled flotation in the prefloat non-sulphidic mineral are minimised.

It is a second object of the present invention to provide a physical separation process for the separation of a non-sulphidic mineral from a sulphidic mineral in which "activation" of the sulphidic mineral and consequential loss in the non-sulphidic prefloat is avoided.

SUMMARY OF THE INVENTION

With these objects in view, the present invention provides a flotation process for the separation of a mineral of non-sulphidic character from a mineral of sulphidic character characterised in that a slurry containing a mixture of the minerals is subjected to a sequence of mineral dressing operations in which a non-oxidising gas or gas mixture and reducing agent are added in combination to the slurry to achieve an electrochemical potential conducive to the separation of the minerals by flotation.

Conveniently, the non-oxidising gas is selected from the group consisting of inert gases such as nitrogen and argon and gases such as carbon dioxide. Gases such as nitrogen and sulphur oxides e.g. sulphur dioxide, nitrogen dioxide are also included. Mixtures of these gases may also be used and the other reducing agent is preferably selected from the group consisting of ammonium sulphide, ammonium hydrosulphide, sodium sulphide, sodium hydrosulphide, potassium sulphide, potassium hydrosulphide or a sulphide or hydrosulphide of other alkali or alkaline earth metals. Other sulphide, sulphite or sulphoxy agents may also be employed (eg. hydrogen sulphide, sulphur dioxide, dithionate salts).

The mineral of non-sulphidic character may be an oxide, oxidic or carbonaceous mineral of which examples are talc, graphite, brucite and amphiboles, which may have a tendency to float in the absence of specific collectors.

The mineral of sulphidic character may contain base metal sulphides including copper, zinc, lead or nickel sulphides and may, for example, be chalcocite, chalcopyrite, pentlandite, galena or sphalerite.

Naturally floating sulphides, such as molybdenite, and other species such as metallic gold may also be amenable to such separation and treatable by the process according to a second aspect of the present invention.

DETAILED DESCRIPTION OF THE INVENTION

In one embodiment of the process, a mineral ore containing both minerals of sulphidic and non-sulphidic character is crushed, slurried, ground and conditioned with the reducing agent, for example, sodium sulphide to depress the sulphidic mineral and promote flotation of the non-sulphidic mineral and floated. Optionally, conditioning with the reducing agent may be accompanied by conditioning with the non-oxidising gas or gas mixture.

The flotation gas may ideally be a non-oxidising gas, such as nitrogen. By combined influence of the reducing agent and the non-oxidising gas, however this is achieved, a selectivity of separation may be achieved that is not known in conventional processes.

During milling, mineral surfaces are preferably exposed to a reducing environment through optional milling in a non-oxidising gas atmosphere that maintains their sulphidic character and maintains the efficiency of the reducing agents. As a result, the reducing agent has better capability in terms of ensuring depression of the valuable sulphidic mineral. In such a way, loss of this mineral to the prefloat non-sulphidic "gangue" mineral stream is minimised.

For example, the reducing agent and non-oxidising gas may both be added at the comminution or grinding stage or the reducing agent can be added later in a conditioning stage. Further, While oxidation of sulphidic mineral surfaces is certainly suppressed by introduction of a non-oxidising gas during the comminution or grinding stage, this is not mandated by the present invention.

In this way too, an "activation" phenomenon, whereby gangue is surrounded by a layer of floatable sulphide, for example copper sulphide, thus causing the loss of the mineral in the gangue stream may be avoided. Although the addition of a sulphide depressant may assist in this respect, the avoidance of exposure of freshly created sulphidic mineral surfaces to an oxidising environment can only further assist in this process.

Furthermore, a synergy is attainable by use of the non-oxidising gas in that the consumption of the reducing agent, generally both an expensive chemical, or at least one that causes inconvenience in terms of both the requirement of supply to remotely located concentrators as well as mixing and preparation, may be reduced with positive economic effects.

The addition of non-oxidising gases, such as nitrogen, and reducing agents, such as sodium sulphide, whose reducing properties in terms of their effect on slurry electrochemical potential allows for good control of the electrochemical potential, is advantageous to good separation selectivity and efficiency.

The slurry may be conditioned with the non-oxidising gas and reducing agent either in the same or discrete conditioning stages post-milling and prior to flotation or during flotation itself. The agents may be added in amounts to achieve a desired electrochemical potential.

It is not intended to place any limitation upon the point of introduction of the reagents hereabove mentioned.

With respect to the continuity of the process, the process may be conducted under batch, semi-batch or continuous conditions. However, in practice, the process will generally be conducted under continuous conditions with single or multiple conditioning and/or flotation stages. The number of conditioning and/or flotation stages selected should be sufficient to achieve the desired degree of separation of the oxidic and sulphidic materials and may be calculated by appropriate calculation and/or trial and error for a particular ore body.

An alternative embodiment may also be envisaged where the supplementary reducing agent is not required. This would occur in cases where the addition of nitrogen alone is sufficient to enable attainment of a suitably low slurry electrochemical potential to achieve the non-sulphidic mineral from the sulphidic mineral.

However, cases will undoubtedly arise where the use of a further reducing agent with enhanced reducing properties to nitrogen must be adopted. In this respect, the addition of nitrogen may only enable a first threshold electrochemical potential value to be reached. This first threshold electrochemical potential value may be sufficiently high as to not result in the degree of selectivity of separation required to enable production of an economically viable non sulphide mineral concentrate. Losses of valuable mineral to the oxidic or other pre-float product may also be unacceptable. Then, a reducing agent, such as those described above, may be required to ensure that electrochemical potential is reduced to a value below the first threshold value outlined above and that the loss of valuable minerals is reduced to an acceptable level.

Cases may also arise where it is desired to further promote the separation of the non-oxidic mineral by various collectors. While this is unlikely in the cases of naturally floating minerals such as talc, it is not intended to preclude the use of such agents from the scope of the present invention.

It will further be appreciated that the rate of addition of non-oxidisable gas, pH and temperature at which the pre-flotation takes place may be of importance and therefore systems which allow appropriate control over gas addition, alkalinity and temperature may be required.

EXAMPLE 1

By way of example, there follows a description of separation of a talc gangue mineral from a pentlandite mineral now follows.

The pentlandite ore is crushed and then finely ground in a ball mill circuit to which nitrogen is injected to ensure the provision of a non-oxidising atmosphere and ensure avoidance of oxidation of pentlandite mineral surfaces. Additionally, where iron balls are used, corrosion and interference reactions of iron with the pentlandite under oxidising conditions are avoided.

The sodium sulphide was added at an addition rate of 0.1–0.5 g/kg of pentlandite ore at a conditioning point located after the ball mill circuit. The pulp was conditioned for five minutes. Following this step, the flotation was conducted, for example, in Denver cells under nitrogen with otherwise standard conditions. This enables recovery of the "gangue" prefloat. A suitable addition rate for nitrogen or inert gas in the flotation stage is 500 l/hour with an agitation speed for the turbine of the Denver cell of 1200 rpm.

This process enabled substantial recovery of gangue minerals with a very low quantity of entrained pentlandite.

EXAMPLE 2

By way of a second example, there follows a description of separation of a non-sulphidic talcose mineral, predominately talc, from a polymetallic ore containing copper, lead and zinc sulphides. The ore contains magnesia and silica in respective amounts of 4.76% and 27.2% by weight.

A 1 kg charge of crushed ore was slurried in site process water to obtain pulp density 60 wt % solids and milled in a stainless steel rod mill employing stainless steel rods to achieve P75 of approximately 53 microns.

The milled slurry was then repulped to pulp density 35 wt % solids in a 2.7 liter standard "Agitair" laboratory flotation cell operated at 1300 rpm with purging of nitrogen in a conditioning phase. Nitrogen flotation tests were conducted under three conditions, viz:

(a) no reagent addition (standard practice)

(b) sodium sulphide @ 1 kg/t milled ore and nitrogen to achieve slurry electrochemical potential ($E_h$) −25 to −40 mV (c) sodium dithionate @ 1 kg/t milled ore and nitrogen to achieve $E_h$−25 to −40 mV.

In each case nitrogen was employed as the flotation gas. Further, a total of five concentrates were removed at 1, 2, 4, 6 and 8 respectively minutes and assayed for copper, lead and zinc content using standard assay techniques.

The data is tabulated for duplicate tests in the form of cumulative weight recovery of copper, lead and zinc recovered in the talc mineral floated in the example flotation process. The less the proportion of the metals recovered, the more effective the flotation separation.

| Con No | Cumulative Weight Percent (Wt % Recovery) | Cumulative Metal Recovery (%) Cu(%) | Pb(%) | Zn(%) |
|---|---|---|---|---|
| | Test A - Standard Practice. | | | |
| A1 | | | | |
| 1. | 3.94 | 4.79 | 2.51 | 1.18 |
| 2 | 6.78 | 10.49 | 4.73 | 2.17 |
| 3 | 10.44 | 21.41 | 8.32 | 3.73 |
| 4 | 12.43 | 29.30 | 10.77 | 4.82 |
| 5 | 15.54 | 38.66 | 16.09 | 6.66 |
| A2 | | | | |
| 1. | 3.6 | 5.44 | 2.31 | 1.07 |
| 2 | 6.56 | 13.85 | 4.48 | 2.09 |
| 3 | 11.10 | 29.92 | 7.79 | 3.67 |
| 4 | 12.82 | 43.12 | 10.93 | 5.18 |
| 5 | 14.99 | 51.27 | 14.02 | 6.55 |
| | Test B - $Na_2S$/Nitrogen | | | |
| B1 | | | | |
| 1 | 3.56 | 1.50 | 1.64 | 0.9 |
| 2 | 5.47 | 2.51 | 2.70 | 1.65 |
| 3 | 7.41 | 3.84 | 4.07 | 2.54 |
| 4 | 8.60 | 4.81 | 5.14 | 3.26 |
| 5 | 9.61 | 5.71 | 6.23 | 3.98 |
| B2 | | | | |
| 1 | 3.78 | 1.74 | 1.98 | 1.18 |
| 2 | 5.22 | 2.57 | 2.85 | 1.73 |
| 3 | 6.95 | 3.79 | 4.12 | 2.56 |
| 4 | 8.21 | 4.49 | 5.28 | 3.32 |
| 5 | 9.51 | 5.96 | 6.74 | 4.31 |
| | Test C - $Na_2S_2O_4$/Nitrogen | | | |
| C1 | | | | |
| 1 | 3.87 | 1.62 | 2.14 | 0.89 |
| 2 | 5.49 | 2.42 | 3.18 | 1.35 |
| 3 | 7.89 | 3.85 | 4.93 | 2.15 |
| 4 | 9.59 | 5.07 | 6.52 | 2.95 |
| 5 | 10.75 | 5.91 | 7.69 | 3.62 |
| C2 | | | | |
| 1 | 3.37 | 0.92 | 1.57 | 0.70 |
| 2 | 4.96 | 1.41 | 2.46 | 1.09 |
| 3 | 6.94 | 2.15 | 3.78 | 1.69 |
| 4 | 8.25 | 2.74 | 4.84 | 2.20 |
| 5 | 9.61 | 3.42 | 6.12 | 2.88 |

The test data indicate that there is less metal loss to the talc component of the mineral when $Na_2S$/nitrogen or $Na_2S_2O_4$/nitrogen combinations are employed.

The claims defining the invention are as follows:

1. A flotation process for the separation of a mineral of non-sulphidic character from a mineral of sulphidic character, said process comprising subjecting a slurry containing a mixture of the minerals to a sequence of mineral dressing operations in which a non-oxidising gas or a non-oxidising gas mixture and a reducing agent are added in combination to the slurry to achieve an electrochemical potential conducive to the separation of the minerals by flotation, and subjecting the conditioned slurry to flotation separation to float the mineral of non-sulphidic character and to depress the mineral of sulphidic character.

2. The process of claim 1 wherein the non-oxidising gas is selected from the group consisting of nitrogen, argon, carbon dioxide and sulphur dioxide and mixtures thereof.

3. The process of claim 1 wherein said reducing agent contains at least one of sulphur and oxygen.

4. The process of claim 3 wherein said reducing agent is a sulphide of an alkali or alkaline earth metal.

5. The process of claim 3 wherein said reducing agents is selected from the group consisting of ammonium sulphide, ammonium hydrosulphide, sodium sulphide, sodium hydrosulphide, sodium dithionate, potassium sulphide, potassium hydrosulphide, potassium dithionate.

6. The process of claim 1 wherein said mineral of sulphidic character is a base metal sulphide.

7. The process of claim 6 wherein said mineral of sulphidic character is selected from the group consisting of copper, zinc, lead or nickel sulphides and mixtures thereof.

8. The process of claim 6 wherein said base metal sulphide is chalcocite, chalcopyrite, pentlandite, galena or sphalerite.

9. The process of claim 1 wherein said mineral of non-sulphidic character is selected from the group consisting of oxide, oxidic and carbonaceous minerals.

10. The process of claim 9 wherein said mineral of non-sulphidic character is selected from the group consisting of talcose minerals, graphite, brucite, amphiboles and mixtures thereof.

11. The process of claim 10 wherein talcose minerals include talc.

12. The process of claim 1 wherein said non-oxidising gas is selected from the group consisting of nitrogen, argon, carbon dioxide and mixtures thereof.

13. The process of claim 1 wherein said non-oxidising gas is an oxide of sulphur or nitrogen.

14. The process of claim 13 wherein said non-oxidising gas is sulphur dioxide.

15. The process of claim 1 wherein said slurry is conditioned with the reducing agent and non-oxidising gas in the same conditioning stage.

16. The process of claim 1 wherein said slurry is conditioned with the reducing agent and non-oxidising gas in respective discrete conditioning stages.

17. The process of claim 1 wherein said slurry is conditioned with the reducing agent and non-oxidising gas in a flotation stage.

18. The process of claim 1 wherein the reducing agent and/or non-oxidising gas are added in accordance with monitored electrochemical potential of the slurry.

* * * * *